US007392623B2

(12) United States Patent
Back et al.

(10) Patent No.: US 7,392,623 B2
(45) Date of Patent: Jul. 1, 2008

(54) EAVES BEAM WITH FRAMING

(75) Inventors: Mark A. Back, Surfside Beach, SC (US); John E. Welsh, Hamilton, OH (US); J. Michael Riley, Swinton (GB)

(73) Assignee: Park Lane Conservatories Ltd. (GB)

( * ) Notice: Subject to any disclaimer, the term of this patent is extended or adjusted under 35 U.S.C. 154(b) by 284 days.

(21) Appl. No.: 10/770,776

(22) Filed: Feb. 3, 2004

(65) Prior Publication Data

US 2005/0166479 A1 Aug. 4, 2005

(51) Int. Cl.
*E04B 7/04* (2006.01)

(52) U.S. Cl. ..... 52/93.1; 52/96; 52/94; 52/93.2; 52/200; 52/215

(58) Field of Classification Search ..... 52/73, 52/93.1, 96, 94, 91.3, 91.2, 81.3, 92.3, 93.2, 52/272, 200, 213, 215, 3.1
See application file for complete search history.

(56) References Cited

U.S. PATENT DOCUMENTS

| | | | | | |
|---|---|---|---|---|---|
| 1,579,901 | A | * | 4/1926 | Whyte | 52/55 |
| 1,931,750 | A | * | 10/1933 | Blaski | 52/72 |
| 2,078,968 | A | * | 5/1937 | Patterson | 52/93.2 |
| 2,245,689 | A | | 6/1941 | Krueger | 108/1 |
| 2,585,051 | A | * | 2/1952 | Simon | 52/91.1 |
| 2,722,901 | A | * | 11/1955 | Johnson et al. | 52/91.1 |
| 2,790,400 | A | * | 4/1957 | Wasserman | 52/200 |
| 3,012,376 | A | * | 12/1961 | Reddy et al. | 52/96 |
| 3,134,464 | A | * | 5/1964 | Markle | 52/22 |
| 3,150,463 | A | | 9/1964 | Nearing et al. | 50/202 |
| 3,176,806 | A | * | 4/1965 | Ferrell | 52/209 |
| 3,308,583 | A | * | 3/1967 | Chaney | 52/92.2 |
| 3,344,566 | A | * | 10/1967 | Miles et al. | 52/94 |
| 3,363,390 | A | | 1/1968 | Crane et al. | 52/716 |
| 3,365,847 | A | * | 1/1968 | Josek | 52/94 |
| 3,456,410 | A | | 7/1969 | Olson et al. | 52/309 |
| 3,624,973 | A | * | 12/1971 | Attaway | 52/60 |
| 3,771,269 | A | * | 11/1973 | Lerch et al. | 52/93.2 |
| 3,866,381 | A | | 2/1975 | Eschbach et al. | 52/731 |
| 3,916,589 | A | | 11/1975 | Richter | |
| 4,037,372 | A | * | 7/1977 | Patry | 52/96 |
| 4,057,941 | A | | 11/1977 | Schwartz | 52/63 |

(Continued)

FOREIGN PATENT DOCUMENTS

| | | |
|---|---|---|
| DE | 8601745.4 | 2/1987 |

(Continued)

OTHER PUBLICATIONS

Park Lane Roof Systems, *Step By Step Guide to Installation—Victorian 5 Face*, Feb. 1996.

(Continued)

*Primary Examiner*—Brian Glessner
*Assistant Examiner*—Phi Dieu Tran A
(74) *Attorney, Agent, or Firm*—Wood, Herron & Evans, LLP

(57) ABSTRACT

An eaves beam with framing which includes an eaves beam with an upper member and a lower member. The framing is comprised of an upper beam and a lower beam. The eaves beam can be pre-attached to the framing, allowing for a more efficient installation.

21 Claims, 3 Drawing Sheets

U.S. PATENT DOCUMENTS

| | | | | |
|---|---|---|---|---|
| 4,068,437 | A | 1/1978 | Byxbe et al. | 52/464 |
| 4,069,627 | A * | 1/1978 | Pegg | 52/93.1 |
| 4,075,811 | A | 2/1978 | Keith | 52/395 |
| 4,106,243 | A * | 8/1978 | Horn | 52/16 |
| 4,109,428 | A * | 8/1978 | Aarons | 52/94 |
| 4,120,122 | A * | 10/1978 | Bahr | 52/58 |
| 4,261,143 | A * | 4/1981 | Rizzo | 52/16 |
| 4,309,853 | A * | 1/1982 | Lowe | 52/91.3 |
| 4,327,532 | A | 5/1982 | Matthews | 52/92 |
| 4,334,393 | A * | 6/1982 | U'Ren | 52/169.6 |
| 4,373,312 | A | 2/1983 | Kim | 52/309.9 |
| 4,404,777 | A * | 9/1983 | Lolley et al. | 52/60 |
| 4,433,514 | A * | 2/1984 | Henges et al. | 52/94 |
| 4,443,508 | A | 4/1984 | Mehl | 428/122 |
| 4,455,803 | A | 6/1984 | Kornberger | 52/395 |
| 4,461,128 | A * | 7/1984 | Knoebl | 52/94 |
| 4,462,390 | A | 7/1984 | Holdridge et al. | 126/430 |
| 4,527,370 | A | 7/1985 | Schuette | 52/282 |
| 4,616,453 | A * | 10/1986 | Sheppard et al. | 52/93.1 |
| 4,621,467 | A | 11/1986 | Golden | 52/81 |
| 4,689,925 | A * | 9/1987 | Granieri | 52/94 |
| 4,731,963 | A * | 3/1988 | Uden et al. | 52/94 |
| 4,784,902 | A | 11/1988 | Crompton | 428/283 |
| 4,872,297 | A | 10/1989 | Hetzel et al. | 52/92 |
| 4,928,425 | A | 5/1990 | Walker, Jr. et al. | 47/18 |
| 4,970,102 | A | 11/1990 | Guillon | 428/122 |
| 5,007,216 | A * | 4/1991 | Pearson | 52/94 |
| 5,036,833 | A | 8/1991 | Quigley et al. | 126/429 |
| 5,058,333 | A | 10/1991 | Schwartz | 52/73 |
| 5,060,291 | A | 10/1991 | Albertelli | 428/306.6 |
| 5,140,768 | A | 8/1992 | Forbes | 47/17 |
| 5,144,776 | A | 9/1992 | Hetzel et al. | |
| 5,209,031 | A * | 5/1993 | Tavano | 52/92.2 |
| 5,215,805 | A | 6/1993 | Pavia, Jr. | 428/159 |
| 5,349,796 | A | 9/1994 | Meyerson | 52/309.11 |
| 5,394,664 | A | 3/1995 | Nowell | 52/200 |
| 5,509,250 | A | 4/1996 | Jensen et al. | 52/200 |
| 5,533,312 | A | 7/1996 | Mihalcheon | 52/309.9 |
| 5,589,243 | A | 12/1996 | Day | 428/56 |
| 5,590,492 | A | 1/1997 | Cucchiara et al. | |
| 5,634,314 | A * | 6/1997 | Champagne | 52/712 |
| 5,740,647 | A * | 4/1998 | Kelly | 52/408 |
| 5,749,197 | A | 5/1998 | Jolly | 52/584.1 |
| 5,826,380 | A | 10/1998 | Wolfe | 52/90.1 |
| 5,829,206 | A * | 11/1998 | Bachman | 52/94 |
| 5,834,082 | A | 11/1998 | Day | 428/56 |
| 5,862,631 | A * | 1/1999 | Attaway et al. | 52/11 |
| 5,913,785 | A * | 6/1999 | M.o slashed.ller et al. | 52/200 |
| 5,927,027 | A | 7/1999 | Richardson | 52/200 |
| 6,000,176 | A | 12/1999 | Lancaster | 52/198 |
| 6,119,410 | A | 9/2000 | Wolfe | 52/71 |
| 6,151,845 | A | 11/2000 | Lancaster | 52/198 |
| 6,185,877 | B1 | 2/2001 | Lloyd | 52/64 |
| 6,223,481 | B1 | 5/2001 | Rickman | 52/90.1 |
| 6,279,290 | B1 | 8/2001 | Richardson | |
| 6,298,619 | B1 | 10/2001 | Davie | 52/293.3 |
| 6,584,735 | B2 | 7/2003 | Burton | |
| 6,631,594 | B2 | 10/2003 | Whiting | 52/204.69 |
| 6,647,683 | B1 | 11/2003 | Thomsen et al. | |
| 2001/0029708 | A1 | 10/2001 | Richardson | 52/57 |
| 2003/0233796 | A1 | 12/2003 | Walz et al. | 52/200 |

FOREIGN PATENT DOCUMENTS

| | | | |
|---|---|---|---|
| EP | 0513934 | A1 | 11/1992 |
| EP | 0644305 | B1 | 3/1995 |
| FR | 2757891 | A | 7/1998 |
| GB | 2204627 | B | 7/1991 |
| GB | 2256880 | A | 12/1992 |
| GB | 2275948 | A | 9/1994 |
| GB | 2287493 | A | 9/1995 |
| GB | 2267298 | B | 2/1996 |
| GB | 2283997 | B | 1/1997 |
| GB | 2288827 | A | 11/1997 |
| GB | 2314875 | A | 1/1998 |
| GB | 2316421 | A | 2/1998 |
| GB | 2347944 | A | 9/2000 |
| GB | 2376961 | A | 12/2002 |
| WO | WO02097213 | A1 | 12/2002 |

OTHER PUBLICATIONS

Park Lane Roof Systems, *Park Lane Conservatory Roofs Data Sheet*.
Park Lane Roof Systems, *Roof Vents Data Sheet*.
Park Lane Roof Systems, *Park Lane Wide Span Data Sheet*.
Park Lane Roof Systems, *Park Lane WIDE-span Assembly Instructions*, 1999.
Park Lane Roof Systems, *Prestige Data Sheet*.
Park Lane Roof Systems, *Elite Data Sheet*.
Park Lane Roof Systems, *Elite Roof Kits Data Sheet*.
Park Lane Roof Systems, *Elite Conservatory Roofing System Assembly Instructions*, Jan. 2001.
Park Lane Roof Systems, *Elite Conservatory Roofing System Brochure*.
Park Lane Roof Systems, *Step By Step Guide to Installation—Victorian 3 Face*, Feb. 1996.
Park Lane Roof Systems, *Highlight 600 Brochure*.
Park Lane Roof Systems, *Park Lane Conservatory Roof Systems Brochure*.
Park Lane Roof Systems, *Step By Step Guide to Installation—Edwardian*.
Park Lane Roof Systems, *Park Lane Series II Assembly Instructions*, 1999.
Park Lane Roof Systems, *Park Lane Roof Systems Brochure*, Jul. 1995.
Park Lane Roof Systems, *Park Lane Brochure*.
Park Lane Roof Systems, *ELITE Conservatory Roofing Systems Document*.
Park Lane Roof Systems, 25' "*Wide Span" Conservatories Document*.
Park Lane Roof Systems, 25' *Fixed Pitch Conservatory Roof Document*.
Park Lane Roof Systems, *Park Lane Variable Pitch Conservatory Roof Document*.
Aluminum Profiles and Accessories Ltd., *Conservatory and Roofing System Handbook* (1991).

* cited by examiner

EAVES BEAM WITH FRAMING

BACKGROUND OF THE INVENTION

Typically glazed roofs are assembled on-site. The walls, supporting posts, rafters and beams are assembled to form a complete conservatory roof and enclosed structure. The beam rafters and panels of the glazed roof are then assembled at the job site.

On-site construction is problematic simply because it is very labor intensive and requires a great deal of time to ensure that everything is properly installed to prevent leakage and other like problems. Even with relative small roofs, such as a bay window roof, on-site fabrication is required and can be expensive due to the labor costs.

SUMMARY OF THE INVENTION

It is an object of the present invention to provide an eaves beam for a glazed roof system which is easier to install and allows for pre-assembly of a glazed roof prior to being attached to a support structure. It is further an object of the present invention to provide for an eaves beam system that can be adapted to accommodate a wide range of exterior sidings such as wood, vinyl, aluminum, masonry, and the like.

The objects and advantages of the present invention are provided by an eaves beam with framing. The eaves beam is adapted to rest on a support frame which in a preferred embodiment is comprised of an upper beam and a lower beam the upper beam being wider than the lower beam. The frame runs the length of the eaves beam and allows the eaves beam to be pre-attached to the frame. The framing provides either an area for siding or an area for brick. With this construction, the conservatory roof can be pre-assembled at the factory, transported to the installation site, and installed on top of its support structure. The present invention thus minimizes the on-site fabrication and assembly time.

DETAILED DESCRIPTION OF THE INVENTION

Figure 1:
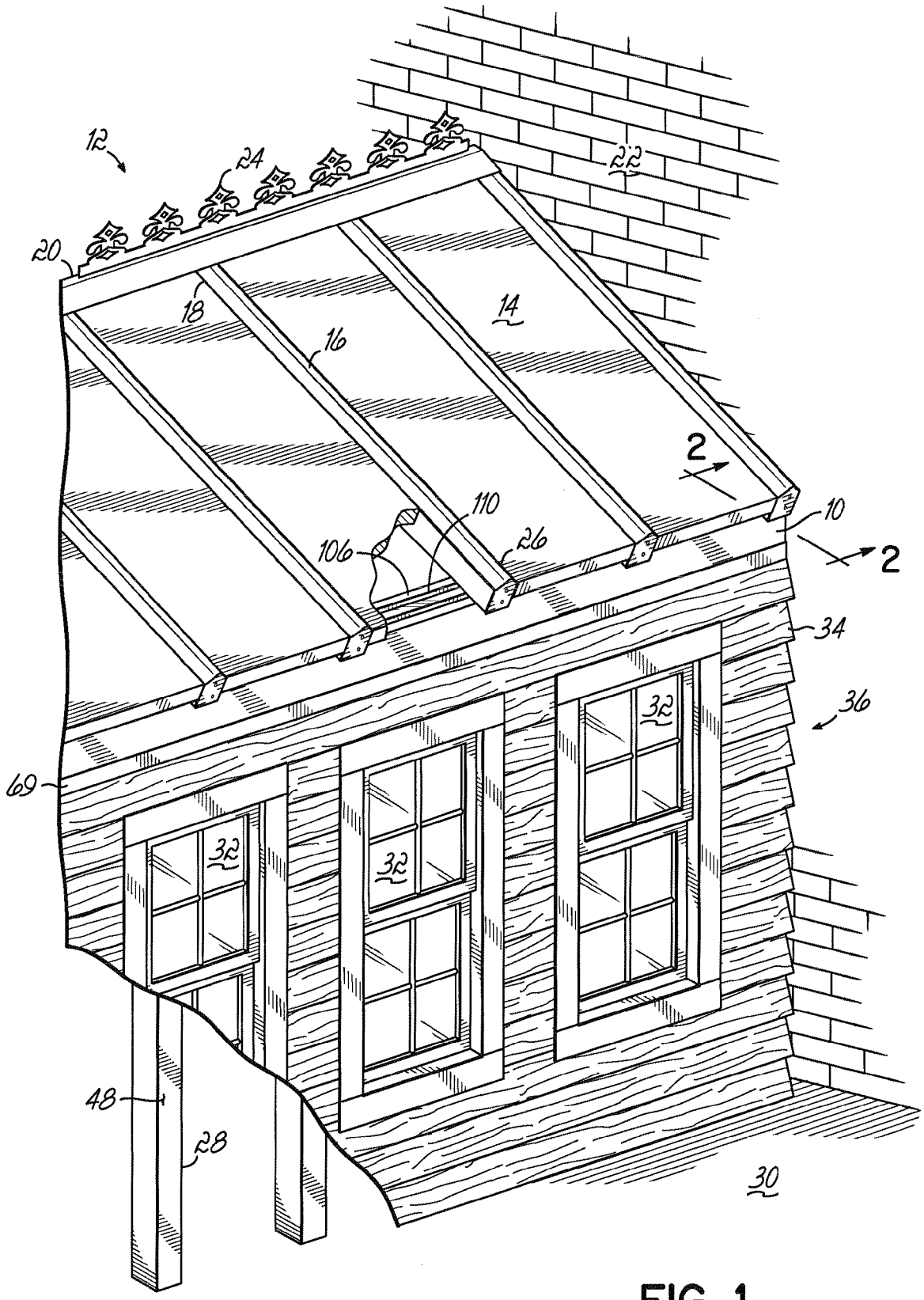
FIG. 1 is a perspective view of a glazed roof with an eaves beam, supporting posts, and siding according to the present invention.

As shown in FIG. 1, the present invention provides for an eaves beam 10 for use in a glazed roof system 12. As exemplarily shown, the glazed roof 12 incorporates a series of panels 14 which are supported by a plurality of rafters 16. The panels 14 constitute the majority of the surface area of the conservatory roof 12. The panels can be glass, plastic, or foil covered foam panels.

The rafters 16 are generally attached at an upper end 18 to a ridge beam 20, which as shown, typically extends outward from a wall 22 of a house or other building. The ridge beam 20 may be adorned with a decorative crest 24 which may be bolted or otherwise fastened to ridge beam 20. The lower ends 26 of the rafters 16 are supported on the eaves beam 10.

The eaves beam 10 is supported by a support structure, exemplarily shown in FIG. 1 as a stud wall 28, typically of 2×4 construction. The support structure 28 rests upon the ground, floor, or similar foundational surface 30.

Although most of the surface area will be taken up by windows 32, siding 34 which could be comprised of wood, vinyl, aluminum, brick veneer, or the like, covers a portion of the wall 36 not taken up by window.

Figure 2:
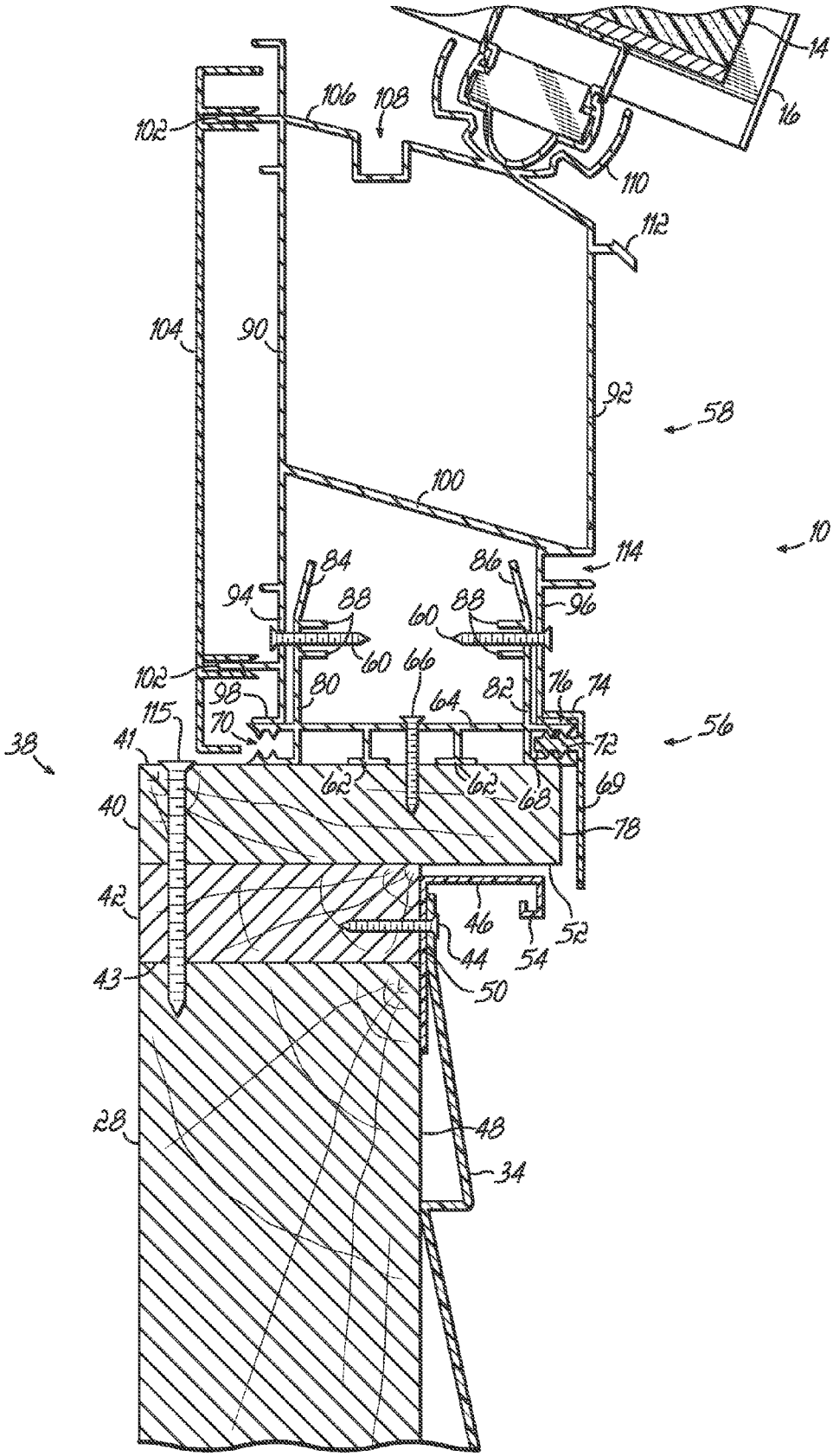
FIG. 2 is a cross-sectional view taken at lines 2-2 of FIG. 1.

As shown in FIG. 2, the eaves beam 10 rests on frame 38. The frame 38 is comprised of an upper beam 40, with an upper surface 41 and a lower or header beam 42, with a lower surface 43. In other embodiments, a single or composite beam could be used, or more than two beams could be utilized. As shown, the lower beam 42 is comprised of a standard 2×4 inch board, which typically will have an actual dimension of 38×89 mm (1½"×3½"). The upper beam 40 will be wider and typically be a standard 2×6 inch board, which typically will have actual dimensions of 38×140 mm (1½"×5½"). The frame 38 is generally horizontally orientated and runs longitudinally the length of the eaves beam 10.

A J-channel 46 is attached by a plurality of screws or fasteners 44 to the top edge of stud wall 28. This trim piece 46 which is typically sandwiched between the lower beam 42 and the siding 34 and positioned on the outside surface 48 of the support structure 28 immediately below the extended edge 52 of beam 40. The siding 34 is secured to the stud wall 28 with its uppermost edge resting in the J-channel 46.

The eaves beam 10, which is positioned on top of the frame 38, is exemplarily shown as a two-piece unit having a base member 56 and an upper member 58. The upper member 58 is attached to the base member 56 with a plurality of screws, nails, staples, or other like fasteners 60. The base member 56, as shown, rests on the upper beam 40 of frame 38. The base member 56 includes a plurality of feet 62 extended from a base surface plate 64. The base plate 64 is secured to the upper beam 40 of the frame 38 with a plurality of screws, nails, staples, or other like fasteners 66. The base member 56 also includes an outer groove 68 which is designed to accept a flashing 69. The base member 56, as shown, also includes an inner groove 70.

The flashing or trim member 69 includes a mounting barb 72 which is designed to mate with groove 68. The flashing 69 also includes a horizontal arm 74 which is designed to sandwich the outside foot 76 of the upper member 58 of the eaves beam 10 between it and the base plate 64 of the base member 56 of the eaves beam 10. The flashing 69 may be decorative, may serve as a guide for positioning the eaves beam 10 on the frame 38, and may also protect the outside surface 78 of the upper beam 40 from weather and exposure. The flashing 69 will typically run the entire length of the upper beam 40. Typically the flashing 69 will be comprised of plastic, fiberglass, or aluminum, but any like suitable material may be used.

Extending up from the base plate 64 are inner and outer side walls 80, 82. Upper portions 84, 86 of side walls 80, 82 are bent inwardly toward each other. The side walls 80, 82 also include a plurality of stiffening ridges 88.

The top member 58 of the eaves beam 10 includes an inner wall 90 and an outer wall 92. These walls 90, 92 include lower leg members 94, 96 with feet 74, 98 which rest on base plate 64. The lower leg members 94, 96 are spaced slightly outwardly from the walls 80, 82, respectively, of base member 56. The top member 58 further includes a downwardly sloping wall 100 which slopes down from the inner wall 90 to the outer wall 92. This downwardly sloping wall 100 can be used to facilitate internal drainage. Inner wall 90 also includes a plurality of barbed members 102 which are adapted to accept a trim piece 104. Typically the trim piece 104 is comprised of plastic, fiberglass, or aluminum, but any like suitable material may be used.

The upper surface 106 of top member 58 includes a trough 108 which can be utilized to facilitate moisture collection and drainage. The top wall 106 further includes a rafter support channel 110 which has a generally C-shaped configuration. Outer wall 92 also includes an upper ledge 112 and a lower channel 114 which are adapted to support either a trim plate or a gutter system (neither of which is shown) if they are desired for a particular application.

In operation, the eaves beam 10 can be installed on the upper beam 40 in a factory. This permits the entire glazed roof assembly 12, including the rafters 16 and panels 14, to be preassembled in the factory and shipped to the construction site as a module. The entire roof assembly 12 resting on the upper beam 40 can then be placed on top of the lower beam 42 resting on the stud wall 28. The upper beam 40 and lower beam 42 are attached to one another via a bolt, screw, nail or other like fastener 115. Preconstructing the roof saves valuable field construction time and improves the overall quality of the system by standardizing preassembly processes in the factory.

Figure 3:
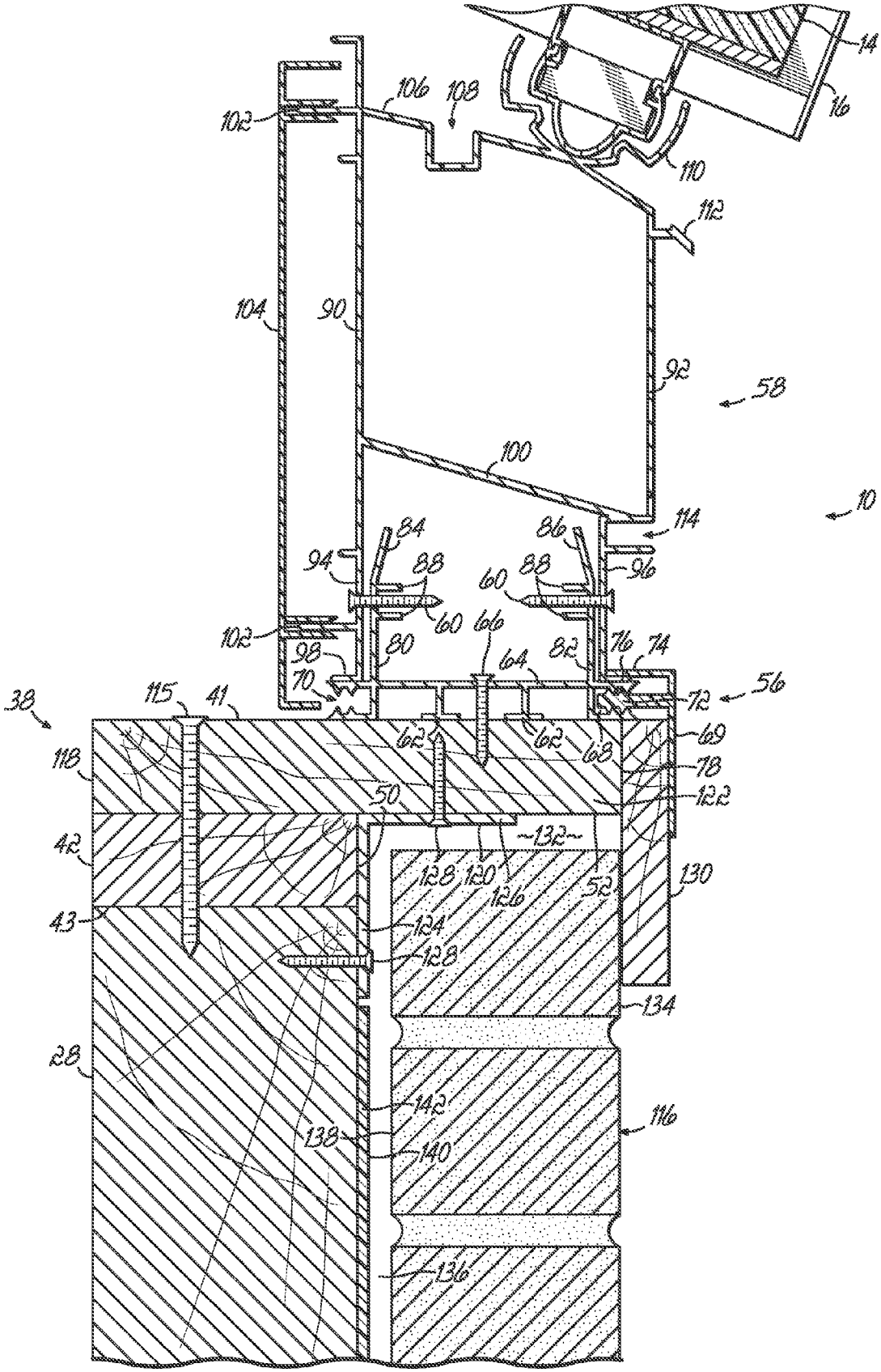
FIG. 3 is a cross-sectional view, similar to FIG. 2, of an alternative embodiment of the present invention.

As shown in FIG. 3, an embodiment of the present invention is adapted for use with brick 116. As shown, the frame 38 utilizes a wider upper beam 118 to accommodate the depth of the bricks 116. As shown, a standard 2×8 inch board is used, which typically has an actual size of 38×184 mm (1½"×7¼"). A brace 120 is attached to the upper beam 118 and the support structure 28 to provide additional support and displacement of the load that will be placed on the outer section 122 of the upper beam 118. As shown, a standard angle iron with a thickness of approximately 6.35 mm (0.25") and a length of approximately 51 mm (2") is used for the brace 120. Each of the arms 124, 126 of the angle iron will typically have a length of approximately 38-51 mm (1½"-2"). While a metal support bracket is shown, other suitable materials may be used. The support bracket 120 is attached to the upper beam 118 and the support structure 28 with a screw, nail, bolt or other suitable fastener 128. The brace 120 may in alternative embodiments run the entire length of the upper beam 118 or may be comprised of a plurality of spaced individual braces positioned along the upper beam 118 at structural advantageous positions, such as where a post or mullion 28 is located. Additionally, in alternative embodiments even those utilizing a wider upper beam 118, the brace 120 could be eliminated depending on the load requirements and characteristics of the upper beam 118 and the frame 38. For example, in warmer climates where increased load factors are not a concern due to the lack of any rooftop snow accumulation, the brace 120 may not be needed.

Similarly, if materials other than wood, such as steel, were used for the frame 38 or the upper beam 118, the need for an additional brace 120 would likely also be eliminated. Finally, if the frame 38 was comprised of a thicker upper beam 118, the support bracket 120 may also be eliminated.

As shown in FIG. 3, an additional trim piece or frame cap 130 is used to create a brick pocket 132. It is advantageous to have a brick pocket 132 to allow room for installing the upper bricks 134 by a bricklayer. The brick pocket 132 provides room for the bricklayer to maneuver the upper bricks 134 in place when the upper beam 118 is installed. The brick edge or frame cap 130, as shown, is comprised of a typical 1×4 inch board, which typically has an actual dimension of 19×89 mm (¾"×3½"). The frame cap 130 runs longitudinally the length of the upper beam 118 and covers the top edge of the bricks. While the brick edge 130 is shown as a board, other suitable materials, such as plastic or metal, may also be used.

The creation of a brick pocket 132 makes it easy to install and finish out the brick wall 116. Of significance, since the brick wall 116 does not support the upper frame being 118 or the eaves beam 10 or roof structure 12, the brick wall 116 can be installed before or after the eaves beam 10 and frame 38 is installed on the stud wall 28. Whether the brick 116 is laid before the roof 12 is installed or after it is secured on the stud wall 28, the brick edge or frame cap 130 can easily be added and sandwiched between the upper frame beam 118 and the flange 69.

This has been a description of the present invention and the preferred mode of practicing the invention. However, the invention itself should only be defined by the claims, wherein we claim:

The invention claimed is:

1. A system for supporting a roof comprising:

a wall, said wall having a thickness;

a support beam resting on said wall, said support beam having a width, said width of said support beam being greater than said thickness of said wall, said support beam having an overhang, said overhang having a width generally equal to the difference of the width of said support beam and said thickness of said wall;

a continuous and uninterrupted eaves beam resting on at least a portion of said overhang of said support beam and along an outer edge of said support beam; and an exterior wall covering attached to said wall, said exterior wall covering positioned below said overhang;

a plurality of spaced vertical studs and a header attached to said studs; and wherein said support beam rests on, is attached to, and is supported by said header.

2. A system for supporting a glazed roof of a building comprising:

a wall structure having a plurality of spaced vertical studs, a header, and an exterior wall covering on an exterior horizontal surface of said wall structure;

a continuous and uninterrupted generally horizontal eaves beam with an upper surface and an opposite spaced base surface;

a plurality of roof rafters positioned over said upper surface of said eaves beam, said eaves beam supporting said plurality of roof rafters;

a frame positioned over said header, said wall covering located below a portion of said frame extended laterally beyond said header, said frame having an upper surface and a lower surface, said upper surface of said frame being attached to said base surface of said eaves beam, said bottom surface of said frame being attached to said-header; and said frame extending longitudinally along the entire length of said eaves beam and supporting said eaves beam along its entire length and attaching said eaves beam to said wall structure.

3. The system of claim 2 wherein said eaves beam is attached to said frame before said frame is attached to said wall structure.

4. The system of claim 2 wherein said frame further comprises:

a plurality of beams.

5. The system of claim 4 wherein width of said plurality of beams is greater than width of said header.

6. The system of claim 2 further comprising a brace attached to said frame and to said wall structure.

7. The system of claim 2 further comprising a frame trim piece attached to said frame, said frame trim piece adapted to receive an edge of said wall covering.

8. The system of claim 7 wherein the frame trim piece is a J-channel.

9. The system of claim 2 further comprising a flashing, said flashing attached to said eaves beam and extending over said frame.

10. The system of claim 2 further comprising:

a channel positioned in said eaves beam; and a flashing attached to said channel, said flashing extending over said frame.

11. The system of claim 10 wherein said flashing is snap-fitted into said channel.

12. The system of claim 9 wherein said frame has an end portion; and wherein a frame cap is attached to said end portion of said frame, said frame cap covering said end portion of said frame and a portion of said wall.

13. The system of claim 12 wherein said frame cap is sandwiched between said frame and said flashing.

14. A system for supporting a glazed roof of a building comprising:

a wall;

a generally horizontal eaves beam with an upper surface and an opposite spaced base surface;

a plurality of roof rafters positioned over said upper surface of said eaves beam, said eaves beam supporting said plurality of roof rafters, said eaves beam having a flashing channel;

a generally horizontal wooden upper frame beam having an end portion, said upper frame beam attached to said base surface of said eaves beam, said upper frame beam having a width, said upper frame beam paralleling said eaves beam and longitudinally coextending with and contacting said eaves beam, said upper frame beam contacting and supporting said eaves beam;

a generally horizontal wooden header beam attached to and supporting said upper frame beam and attached to said wall, said lower frame beam having a width, said width of said header beam being narrower than said width of said upper beam wherein said upper frame beam has an overhang extending laterally beyond said header beam, said header beam paralleling said upper beam and longitudinally coextending with said upper frame beam;

a wall covering located below said overhang;

a flashing snap-fitted into said flashing channel, said flashing covering said end portion of said upper frame beam; and a J-channel attached to said lower frame beam, said J-channel adapted to receive the edge of said wall covering.

15. A system for supporting a glazed roof of a building comprising:

a wall;

a generally horizontal eaves beam with an upper surface and an opposite spaced base surface;

a plurality of roof rafters positioned over said upper surface of said eaves beam, said eaves beam supporting said plurality of roof rafters, said eaves beam having a flashing channel;

a generally horizontal wooden upper frame beam having an end portion, said upper frame beam attached to said base surface of said eaves beam, said upper frame beam having a width, said upper frame beam paralleling said eaves beam and longitudinally coextending with said eaves beam, said upper frame beam contacting and supporting said eaves beam;

a generally horizontal wooden header beam attached to and supporting said upper frame beam and attached to said wall, said header beam having a width, said width of said header beam being narrower than said width of said upper beam wherein said upper frame beam has an overhang extending laterally beyond said header beam, said header beam paralleling said upper beam and longitudinally coextending with said upper frame beam;

a wall covering located below said overhang;

a flashing snap-fitted into said flashing channel, said flashing covering said end portion of said upper frame beam;

a wooden frame cap attached to said upper frame beam, said wooden frame cap sandwiched between said upper frame beam and said flashing; and a metal brace attached to and supporting said upper frame beam and attached to said wall.

16. The system of claim 14 wherein at least a portion of said generally horizontal eaves beam rests on and is supported by at least a portion of said overhang.

17. The system of claim 14 wherein said generally horizontal wooden upper frame beam is a standard 2×6 inch board; and wherein said generally horizontal wooden header beam is a standard 2×4 inch board.

18. The system of claim 14 wherein said generally horizontal wooden upper frame beam is a standard 2×8 inch board; and wherein said generally horizontal wooden header beam is a standard 2×4 inch board.

19. The system of claim 15 wherein at least a portion of said generally horizontal eaves beam rests on and is supported by at least a portion of said overhang.

20. The system of claim 15 wherein said generally horizontal wooden upper frame beam is a standard 2×6 inch board; and wherein said generally horizontal wooden header beam is a standard 2×4 inch board.

21. The system of claim 15 wherein said generally horizontal wooden upper frame beam is a standard 2×8 inch board; and wherein said generally horizontal wooden header beam is a standard 2×4 inch board.

* * * * *